US005595307A

United States Patent [19]

Hautala

[11] Patent Number: 5,595,307

[45] Date of Patent: Jan. 21, 1997

[54] METHOD OF MAKING A SCREEN CYLINDER, AND A SCREEN CYLINDER

[75] Inventor: Jouko Hautala, Tampere, Finland

[73] Assignee: Valmet Corporation, Tampere, Finland

[21] Appl. No.: 526,265

[22] Filed: Sep. 11, 1995

[30] Foreign Application Priority Data

Sep. 27, 1994 [FI] Finland ..... 944484

[51] Int. Cl.[6] ..... B07B 1/49

[52] U.S. Cl. ..... 209/395; 209/411

[58] Field of Search ..... 209/393, 395, 209/405, 411, 412

[56] References Cited

U.S. PATENT DOCUMENTS

| | | | |
|---|---|---|---|
| 2,046,458 | 7/1936 | Johnson | 209/393 X |
| 5,011,065 | 4/1991 | Musselmann | 209/411 X |
| 5,094,360 | 3/1992 | Lange | 209/411 X |
| 5,472,095 | 12/1995 | Malm | 209/395 X |
| 5,503,323 | 4/1996 | Bergkvist et al. | 209/395 X |

FOREIGN PATENT DOCUMENTS

| | | |
|---|---|---|
| 4107905 | 9/1992 | Germany . |
| 4224727A1 | 2/1994 | Germany . |
| 9423847 | 10/1994 | WIPO . |

*Primary Examiner*—D. Glenn Dayoan
*Attorney, Agent, or Firm*—Ladas & Parry

[57] ABSTRACT

A method of making a screen cylinder, in which method mesh wires (2) are arranged next to one another and attached inside the ring-shaped supporting rods (3) to provide a cylindrical mesh surface, and a screen cylinder which includes mesh wires (2) arranged next to one another to provide a cylindrical mesh surface, the mesh wires being attached to the supporting rods (3) surrounding them. In the method, supporting rings (4) are positioned around the supporting rods (3) without fastening the supporting ring (4) to the supporting rod (3), and the supporting ring (4), when it is put in place, is tightened such that it presses the supporting ring (3) in the radial direction of the mesh cylinder. The mesh cylinder is made of a supporting ring (4) which is positioned around the supporting rod (3) without fastening it to the supporting rod (3) and which is tightened around the supporting rod (3) so firmly that it presses the supporting rod (3) in the radial direction of the screen cylinder.

5 Claims, 1 Drawing Sheet

METHOD OF MAKING A SCREEN CYLINDER, AND A SCREEN CYLINDER

BACKGROUND OF THE INVENTION

1. Field of the Invention

The invention relates to a method of making a screen cylinder, in which method mesh wires are arranged next to one another at predetermined intervals and attached in the axial direction of the screen cylinder to provide a cylindrical mesh surface on the inside of ring-shaped supporting rods, and at least some of the supporting rods are surrounded on the outside with supporting rings that support them.

The invention also relates to a screen cylinder for purifying and sorting out a pulp mixture, the screen cylinder comprising mesh wires arranged in the axial direction of the screen cylinder at predetermined intervals to provide a cylindrical mesh surface, the mesh wires being attached to the surrounding supporting rods, and at least some of the supporting rods being surrounded on the outside by a supporting ring.

2. Description of the Prior Art

Screen cylinders are made by attaching parallel mesh wires that provide a mesh surface next to one another in a cylindrical shape at desired intervals. This is usually done by welding or brazing the wires to the supporting rods; this is difficult, and the welding also produces flashes. In addition, the welding produces stress on the perimeters due to different thermal expansion and shrinkage. Another problem is that the screen cylinder requires a supporting structure in which the separate supporting rings are usually welded to the supporting rods to provide a uniform structure. As a result, the varying pressure and mechanical load put stress on the inside of the cage during the use, and the stress, which is distributed over the radially extending area formed by the supporting ring and the mesh wire, may cause the structure to crack. This is particularly evident in a solution where the mesh wires are welded to the supporting rods.

SUMMARY OF THE INVENTION

The object of the present invention is to provide a method of making a screen cylinder by which the above problems of stress can be avoided and by which the screen cylinder is easy to implement.

The method of the invention is characterized in that the supporting rings are positioned around the corresponding supporting rods without attaching the supporting ring to the supporting rod, and that the supporting ring, when it is put in place, is tightened around the supporting rod so firmly that it presses the supporting rod in the radial direction of the screen cylinder.

Another object of the invention is to provide a screen cylinder that endures stress better than the prior art solutions and is therefore more reliable.

The screen cylinder of the invention is characterized in that the supporting ring is positioned around the corresponding supporting rod without fastening it to the supporting rod, and that the supporting ring, when it is put in place, is tightened around the supporting rod so firmly that it presses the supporting rod in the radial direction of the screen cylinder.

An essential idea of the invention is that the supporting rings and the supporting rods of the screen cylinder are arranged to be separate from one another such that the supporting ring is pressed around the supporting rod, whereby the supporting ring presses the supporting rod inwardly from its outer surface, thereby producing more compression stress than tensile load to the supporting rod.

Another essential idea is that the supporting ring is not in any way fastened to the supporting rod, but is only pressed against the outer surface of the supporting rod. The essential idea of one preferred embodiment of the invention is that grooves are provided in the supporting rod at predetermined intervals, the mesh wires being arranged therein without welding them to the supporting rod, and the supporting rod being compressed with a supporting ring such that it presses the mesh wires in its grooves, whereby they are held firmly in position.

An advantage of the invention is that a screen cylinder produced by this method is easy to implement, since it is easy to attach the mesh wires to the thin supporting rod and to bend the supporting rod to the desired form. Another advantage is that once the supporting ring has been compressed and attached, it can be machined and welded on its outer surface to eliminate any holes that enhance cracking and to thereby make its strength and load-enduring capacity as good as possible.

BRIEF DESCRIPTION OF THE DRAWINGS

The invention will be described in greater detail in the attached drawing, in which.

DESCRIPTION OF THE PREFERRED EMBODIMENTS

Figure 1:
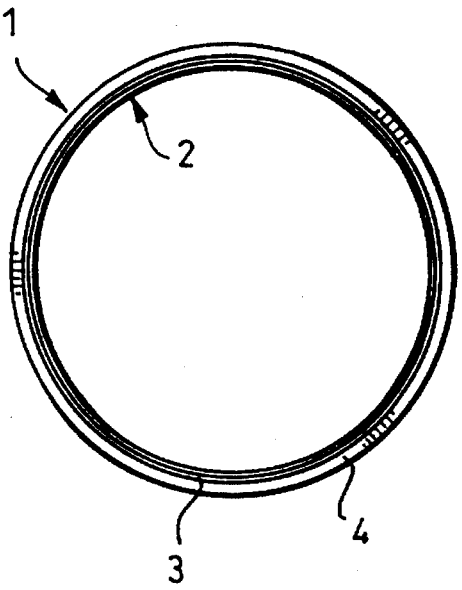
FIG. 1 is a schematic cross-sectional view of a screen cylinder according to the invention, seen in the axial direction.

FIG. 1 is a schematic cross-sectional view of a screen cylinder according to the invention, seen in the axial direction. On the inner surface of a screen cylinder 1, there are mesh wires 2 in the figure around the entire inner perimeter of the screen cylinder 1 to provide a mesh surface. Between the mesh wires 2 there are apertures through which the liquid and the fibres of the type desired are able to pass, whereas sticks, too large fibres and fibre lumps remain on the inner surface of the screen cylinder and are then discharged therefrom through the other end. The mesh wires 2 are attached to supporting rods 3, which are arranged in the shape of a ring to provide a screen cylinder of a suitable size. The supporting rods 3 are arranged in the axial direction of the screen cylinder at suitable intervals such that the mesh wires 2 are held in position in a sufficiently rigid and tight manner. A supporting ring 4 is positioned around the supporting rod 3, the ring supporting the supporting rod 3 and receiving the forces caused by the pressure difference resulting from different varying pressures on different sides of the mesh surface in the screen cylinder.

Figure 2:
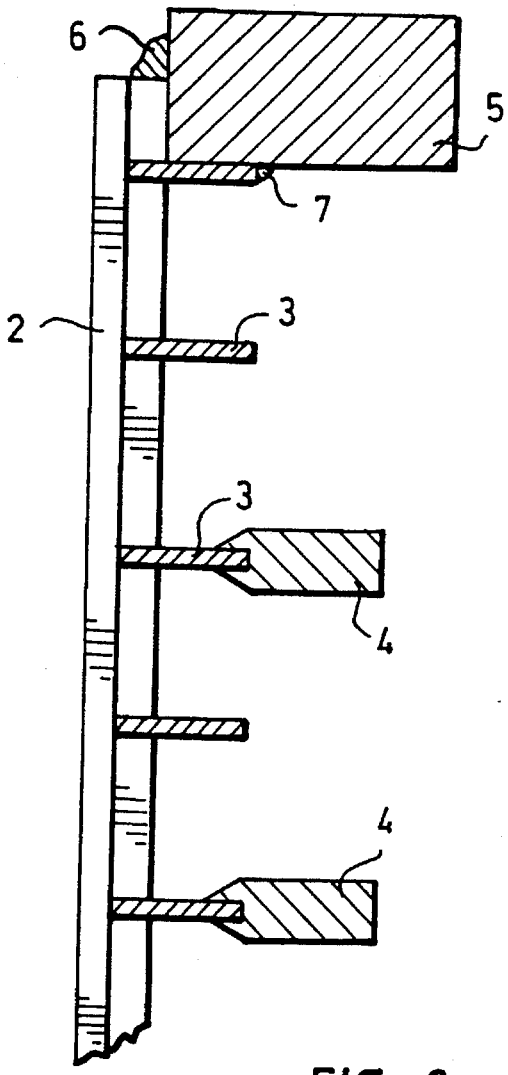
FIG. 2 is a schematic view of an axial section of a screen cylinder according to the invention.

FIG. 2 in turn shows an axial section of a screen cylinder according to the invention, seen from one end of the screen cylinder. In FIG. 2, the same numbers identify the same elements as in FIG. 1. FIG. 2 shows a mesh wire 2 in a vertical direction, the mesh wire being attached to several supporting rods 3 that are one after the other in the vertical direction in the figure. The mesh wires 2 can be attached to the supporting rods 3 in different ways, such as by welding the mesh wires 2 to the supporting rods 3 or by attaching the mesh wires 2 to the supporting rods 3 by a clamp connection, which means that, for example, grooves are provided in the supporting rod 3 and one edge of each mesh wire 2 is positioned therein. The mesh wires 2 can be attached to the supporting rods 3 either mechanically by pressing or in some other way known per se.

The figure also shows a supporting ring 4, which is positioned outside the supporting rod 3 to surround the supporting rod 3. When a screen cylinder is produced, mesh wires 2 can first be attached to supporting rods 3 to provide a cylindrical structure, after which supporting rings 4 can be positioned around the supporting rods 3 and compressed such that they press the supporting rods 3 inwardly in the radial direction of the screen cylinder. The supporting rings 4 are arranged such that a broken supporting ring 4 is positioned around a supporting rod 3, after which the ends of the ring are pressed towards each other such that the ring becomes smaller in size and thereby presses the supporting rod inwards. After this, the ends of the supporting ring 4 are attached to each other by welding to provide a uniform supporting ring. After the welding, the means for tightening the ends of the ring are removed, and the point of welding is scraped to be clean and level, removing any irregularities and holes. It is not necessary to arrange supporting rings 4 at every supporting rod: it is possible to arrange one e.g. at every second or every third supporting rod. When the supporting ring 4 is pressed inwards in this way, the supporting rods 3 are subjected to a compression load, which reduces the load of the supporting rods when the screen cylinder is in use. The supporting ring 4 is advantageously bevelled at the edges in the manner shown in the figure, and it is provided with a groove such that the supporting rod 3 is received by the groove of the supporting ring 4. Advantageously, the edges are bevelled such that the bevel extends from the edge of the groove towards the outer perimeter of the supporting ring. The supporting ring 4 is not attached to the supporting rod 3 in any way, but in principle the supporting ring 4 is able to slide around the supporting rod 3. In practice, the supporting ring 4 and the supporting rod 3, however, hardly move in relation to one another because of the compression force between them.

Both ends of the screen cylinder are also provided with flanges 5, which are attached to the mesh wires 2 at their ends by a weld 6, and to the nearest supporting rod 3 by a weld 7 between them. The flanges 5 can also be attached in some other manner known per se, but in this embodiment this is the simplest solution.

The screen cylinder of the invention can also be implemented in another manner: the mesh wires 2 are arranged inside the rings formed by the supporting rods 3 such that they are held in position, but not attached to, the grooves **3*a* of the supporting rods 3. When the supporting rods 3 are then pressed inwards with the supporting rings 4, a compression force is generated in the supporting rods, and the force presses the mesh wires 2 against the supporting rods 3** without their being attached to them in any other way.

An advantage of the screen cylinder of the invention is that the forces generated in it during the use are distributed more evenly than in known solutions. Because of this, the forces and stresses caused by variation in pressure do not essentially strain the connection between the mesh wire and the supporting rod, since the supporting rings receive most of the load, and so the supporting rods are not able to expand in the radial direction as much as in known solutions.

Figure 3:
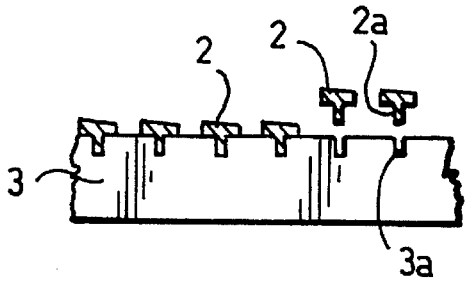
FIG. 3 is a schematic view of one embodiment for attaching the mesh wires and supporting rods to one another.

FIG. 3 shows a schematic view of one embodiment for shaping the mesh wires and the supporting rod such that the mesh wires are in as close contact with the supporting rod as possible. As shown in the figure, the cross-section of the mesh wires comprises a flat attaching part **2*a*, which easily fits into grooves 3*a* provided in the supporting rod 3. The mesh wires 2 are placed in the grooves of the ring-shaped supporting rod 3**. When the supporting rod is then compressed in the radial direction with the supporting ring in the manner described above, the mesh wires are pressed against the supporting rod, and if desired, the supporting rod can be pressed with the supporting ring such that the entire wire is subjected to compression force.

The invention has been described above in the specification and the drawing by way of example, and it is not in any way restricted to the above. The invention can thus be modified freely within the scope of the claims. The mesh wires can be attached to the supporting rod either by welding, by a clamp connection, or in a manner known per se. Supporting rings can be provided either at every supporting rod, or at suitable intervals e.g. at every second or every third supporting rod. Also, the mesh wires can first be placed in the grooves of the supporting rods, after which the supporting rod is bent to form a ring such that the mesh wires are pressed in place to some extent. If the clamp connection between the supporting rods and mesh wires is pressed with the supporting ring, the connection becomes even tighter.

I claim:

1. A wire cage for purifying and sorting out a pulp mixture, the wire cage comprising mesh wires arranged in the axial direction of the wire cage at predetermined intervals to provide a cylindrical mesh surface, the mesh wires being attached to supporting rods, and at least some of the supporting rods being surrounded on the outside by a supporting ring, and the supporting ring being positioned around the corresponding supporting rod without fastening it to the supporting rod, and the supporting ring, when it is put in place, being tightened around the supporting rod so firmly that it presses the supporting rod in the radial direction of the wire cage.

2. A wire cage according to claim 1, wherein the mesh wires are placed in grooves formed in the supporting rod without attaching them to the supporting rod in any other way, and wherein the supporting ring, when it is positioned around the supporting rod, is tightened so much that the supporting rods press inwardly in the radial direction, pressing the mesh wires tightly between the edges of the grooves in the supporting rod.

3. A wire cage according to claim 1, wherein the supporting ring has on the inside a groove that is of the same width as the supporting rod, and wherein the supporting ring is positioned around the supporting rod such that the supporting rod is in said groove.

4. A wire cage according to claim 3, wherein the inner edge of the supporting ring is bevelled such that the bevelled surface extends essentially from the edge of said groove towards the outer edge of the supporting ring.

5. A method of making a wire cage comprising the steps of:

a) arranging mesh wires next to one another at predetermined intervals and attaching them to the inside of ring-shaped supporting rods, said mesh wires being attached in the axial direction of the ring-shaped supporting rods to provide a cylindrical mesh surface on the inside of the ring-shaped supporting rods, b) supporting at least some of the ring-shaped supporting rods with support rings by positioning the support rings around the outside of the supporting rods without fastening the support rings to the supporting rods, and, c) tightening the support rings firmly so that they press the supporting rods in the radial direction of the ring-shaped supporting rods.

* * * * *